US010117805B2

(12) United States Patent
Cho et al.

(10) Patent No.: US 10,117,805 B2
(45) Date of Patent: Nov. 6, 2018

(54) ACUPRESSURE DEVICE

(71) Applicant: SNU R&DB FOUNDATION, Seoul (KR)

(72) Inventors: Kyu Jin Cho, Seoul (KR); Sang Yoep Lee, Seoul (KR); Merewether Gene Brown, Seoul (KR)

(73) Assignee: SNU R&DB FOUNDATION, Seoul (KR)

( * ) Notice: Subject to any disclaimer, the term of this patent is extended or adjusted under 35 U.S.C. 154(b) by 772 days.

(21) Appl. No.: 14/667,679

(22) Filed: Mar. 25, 2015

(65) Prior Publication Data

US 2016/0279028 A1 Sep. 29, 2016

(51) Int. Cl.

| | |
|---|---|
| ***A61H 39/04*** | (2006.01) |
| *A61H 23/02* | (2006.01) |
| *A61H 31/00* | (2006.01) |
| *A61H 11/00* | (2006.01) |

(52) U.S. Cl.

CPC ..... *A61H 39/04* (2013.01); *A61H 23/02* (2013.01); *A61H 31/00* (2013.01); *A61H 2011/005* (2013.01); *A61H 2201/0149* (2013.01); *A61H 2201/1628* (2013.01); *A61H 2203/0431* (2013.01); *A61H 2205/083* (2013.01)

(58) Field of Classification Search

CPC .. A61H 11/00; A61H 2011/005; A61H 39/04; A61H 2203/0431; A61H 2201/1628; A61H 2201/0149; A61H 31/00; A61H 23/02; A61H 2205/083; A61H 23/00; A61G 5/00; A61G 5/02; A61G 5/04

See application file for complete search history.

(56) References Cited

U.S. PATENT DOCUMENTS

| | | | | | |
|---|---|---|---|---|---|
| 4,770,164 | A * | 9/1988 | Lach | A61H 31/005 | 601/41 |
| 5,334,131 | A * | 8/1994 | Omandam | A61H 23/0263 | 601/70 |
| 5,823,913 | A * | 10/1998 | Aruin | A63B 23/0244 | 482/4 |
| 6,015,394 | A * | 1/2000 | Young | A61G 7/057 | 297/DIG. 4 |
| 6,066,106 | A * | 5/2000 | Sherman | A61H 31/006 | 601/134 |
| 7,537,069 | B2 * | 5/2009 | Kramer | A47C 7/62 | 180/21 |
| 7,883,484 | B1 * | 2/2011 | Wu | A61H 11/02 | 601/144 |
| 8,043,237 | B1 * | 10/2011 | Wu | A61H 11/02 | 601/143 |
| 2006/0009720 | A1 * | 1/2006 | Chung | A61H 11/00 | 601/143 |
| 2008/0004551 | A1 * | 1/2008 | Goodell | A61H 11/00 | 601/41 |

(Continued)

*Primary Examiner* — Quang D Thanh
(74) *Attorney, Agent, or Firm* — LEEPI

(57) ABSTRACT

An acupressure device includes an acupressure section, a driving part and a control part. The acupressure section is disposed in front of the belly and presses the belly. The driving part is connected to the acupressure section and fixed at a backside of a user and moving the acupressure section toward the belly. The control part is controlled by the user and changing an intensity of a pressure from the acupressure section.

8 Claims, 7 Drawing Sheets

(56) References Cited

U.S. PATENT DOCUMENTS

| | | | | |
|---|---|---|---|---|
| 2008/0119764 | A1* | 5/2008 | Song | A61H 11/00 601/23 |
| 2008/0200853 | A1* | 8/2008 | Tielve | A61H 1/0292 601/134 |
| 2008/0319359 | A1* | 12/2008 | Moomiaie-Qajar | A61H 11/00 601/152 |
| 2011/0264019 | A1* | 10/2011 | Park | A61H 23/00 601/108 |
| 2012/0010049 | A1* | 1/2012 | Amalaha | A61H 23/0254 482/4 |
| 2014/0135187 | A1* | 5/2014 | Wu | A61H 11/02 482/110 |

* cited by examiner

ACUPRESSURE DEVICE

BACKGROUND

1. Field of Disclosure

The present disclosure of invention relates to an acupressure device assisting breath. More particularly, the present disclosure of invention relates to an acupressure device assisting breath for disabled or old people.

2. Description of Related Technology

Recently, various devices for disabled or old people have been developed and an assisting device has become popular among people. Disabled or old patients suffer from disease in a progressive neuromuscular junction, injuries to their spine and to their respiratory system.

A problem of cough, abdominal muscle strength and hypotension can cause difficulties in breathing, vocalization, vertigo and shock when patients sits wheelchair for a long time.

Also, when they have a problem in respiratory system, the problem can be disastrous for people singing for a living. Although, apparatuses like Pneumobelt, Rocking bed, cough guidance device and Artificial ventilator have been used for the treatment of the problem and disease, the apparatuses have large volume so that the patients could not use outside.

Thus, portable and breathing-assisting device is needed to be invented for convenience of the patients.

SUMMARY

The present invention is developed to solve the above-mentioned problems of the related arts. The present invention provides an acupressure device which is portable and helping a vocalization by an assistance of breathing.

According to an exemplary embodiment, an acupressure device includes an acupressure section, a driving part and a control part. The acupressure section may be disposed in front of a belly and pressing the belly. The driving part may be connected to the acupressure section and fixed at a backside of a user, and moving the acupressure section toward the belly. The control part may be controlled by the user and changing an intensity of a pressure of the acupressure section.

In an embodiment, the acupressure section includes an acupressure pad, a first and second acupressure belts. The acupressure pad may contact with a middle of the belly.

The first and second acupressure belts may be detachably connected to both ends of the acupressure pad respectively.

In an embodiment, the driving part includes a belt, a retractor and a motor. The belt may respectively be connected to the first and second acupressure belts. The refractor may be wound or unwound by the belt. The motor may be driving the refractor.

In an embodiment, the driving part may be fixed on the wheelchair.

In an embodiment, the acupressure section may be disposed at a front portion of the wheelchair and the driving part may be disposed at a rear portion of the wheelchair.

In an embodiment, the acupressure device further includes a motor case. The motor case may be covering the driving part. The motor case includes a battery and a case. The battery may be supplying electric power to the driving part. The case door may be opening and closing an inner space.

In an embodiment, the control part includes a joystick and a safe button. The joystick may be controlling the driving part. The safe button may closely be adjacent to the joystick and stopping an operation of the motor.

In an embodiment, the wheelchair may be an electric wheelchair.

In an embodiment, the control part includes a joystick. The joystick may be controlling a movement of the electric wheelchair by changing a switch.

According to the present example embodiments, the acupressure device is highly portable and helps people using wheelchair breathe by ergonomically pressing the belly with a pad and a belt so that the acupressure device decreases the possibility of low blood pressure and shock and increases the convenience for use and stability of the device.

In addition, the acupressure device may press the belly in the moment of singing or practicing the vocalization and be adaptable to music with a fast tempo because the intensity of the pressure of the acupressure device may be controlled minutely and quickly. In addition, the acupressure device may be useful as a seat belt when the acupressure pad is connected to the second acupressure belt. The acupressure device has the safe button 120*b* which stops the wheelchair 10 and allows the joystick 120*a* to control the intensity of the pressure.

In addition, the acupressure device 100 helps old and disabled people significantly to lose their belly's fat when the acupressure pad and the first and second acupressure belts is used as a massage belt by exchanging the motor 230*b* for the vibration motor.

BRIEF DESCRIPTION OF THE DRAWINGS

The above and other features and advantages will become more apparent by describing exemplary embodiments thereof with reference to the accompanying drawings, in which.

DETAILED DESCRIPTION

Hereinafter, exemplary embodiment of the invention will be explained in detail with reference to the accompanying drawings.

Figure 1:
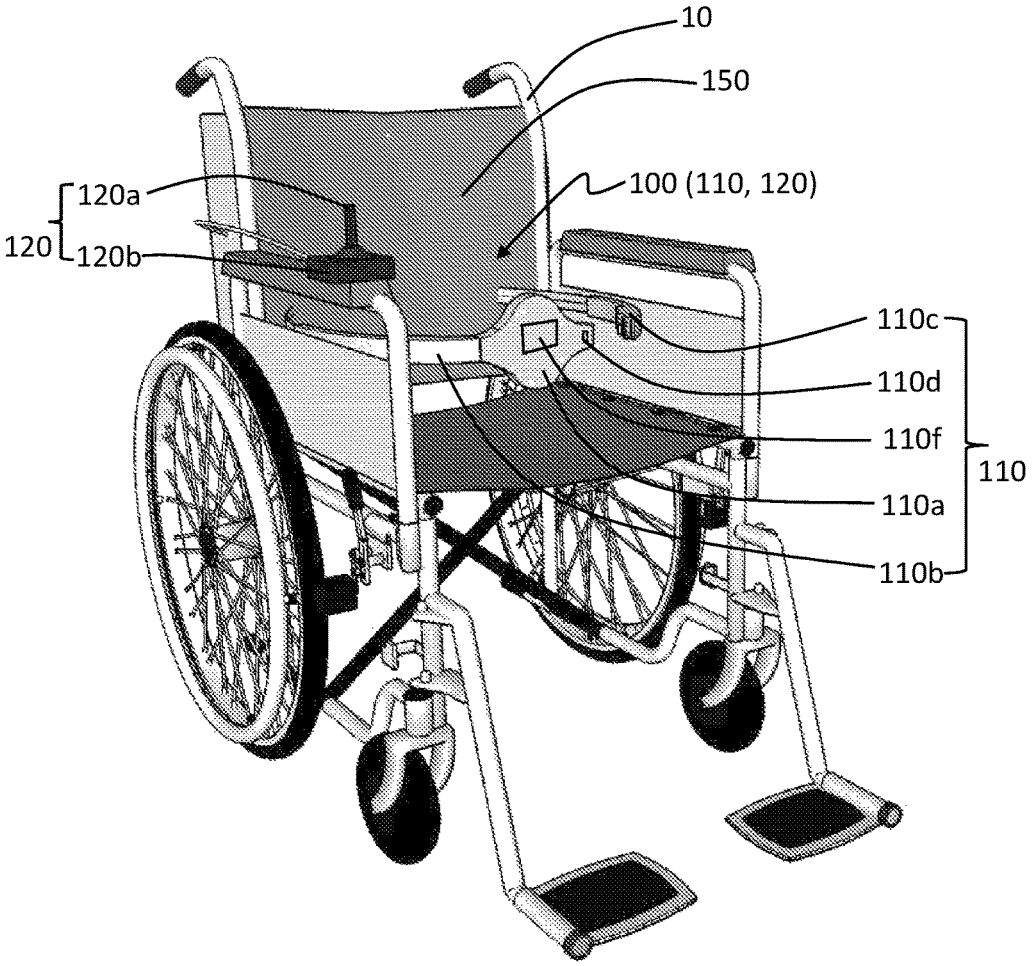
FIG. 1 is an exploded perspective view illustrating an acupressure device assisting breath according to an example embodiment of the present invention.
Figure 2:
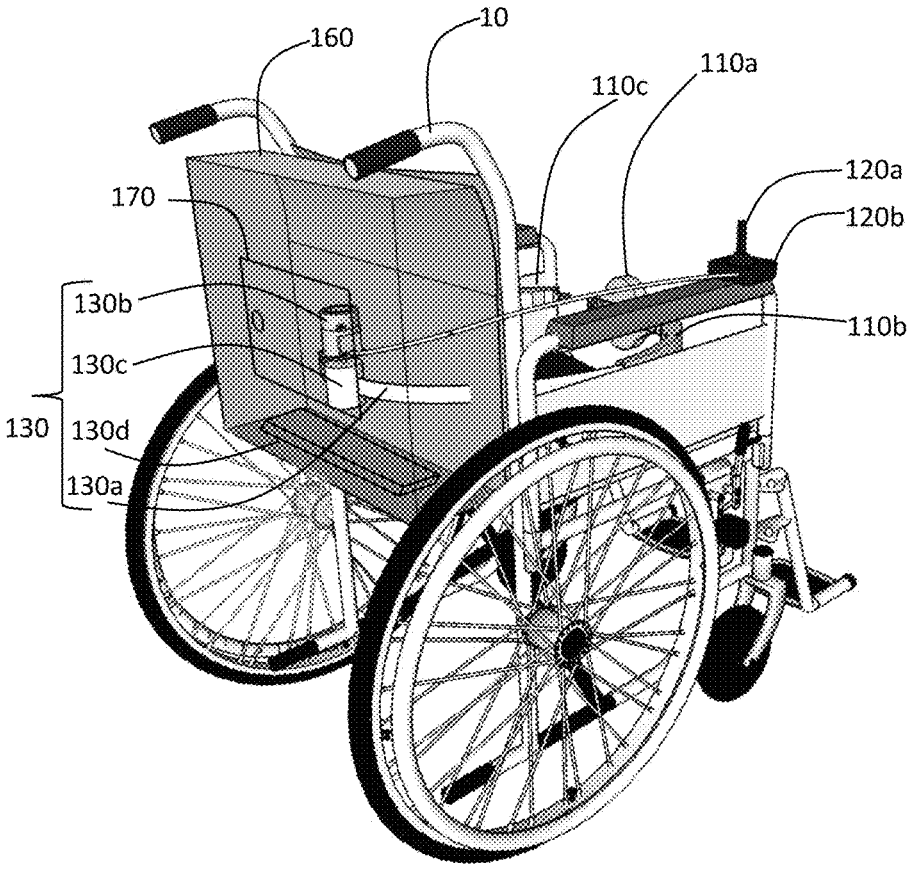
FIG. 2 is an exploded perspective view illustrating the acupressure device in FIG. 1.

FIG. 1 is an exploded perspective view illustrating an acupressure device assisting breath according to an example embodiment of the present invention. FIG. 2 is an exploded perspective view illustrating the acupressure device in FIG. 1

Referring to FIGS. 1 and 2, the acupressure device 100 includes an acupressure section 110, a control part 120, a driving part 130, a back supporting portion 150, a motor case 160 and a case door 170

The acupressure section 110 includes an acupressure pad 110*a*, a first acupressure belt 110*b*, a second acupressure belt 110*c* and a release button 110*d*. The control part 120 includes a joystick 120*a* and a safe button 120*b*. The driving part 130 includes a belt 130*a*, a motor 130*b*, a refractor 130*c* and a battery 130*d*.

Referring to FIGS. 1 and 2, the acupressure pad 110*a* is disposed in front of the wheelchair 10. A first end portion of the acupressure pad 110*a* is connected to the first acupressure belt 110*b* and a second end portion of the acupressure pad 110*a* is connected to the second acupressure belt 110*c*. The acupressure pad 110*a* may be detached by pushing the release button 110*d*. The acupressure pad 110*a* has spherical protrusion to the upper and lower side. The protrusions softly cover the belly.

In addition, the acupressure pad 110*a* may include a hard and flexible material, and have a motor inside so as to be used as a massage pad. Alternatively, the acupressure pad 110*a* may include a less flexible material like metal, polymer and ceramic so as to provide wide and overall pressure to the belly.

The first and second acupressure belts 110*b* and 110*c* are connected to the acupressure pad 110*a* and each acupressure belts 110*b* and 110*c* may be detachable. The first and second acupressure belts 110*b* and 110*c* have protrusions to the belly and the back supporting portion 150 so as to pressure the front of the belly as well as the side when they pressure the belly. In this case, the pressure of the belly may help a user to breath by pressuring the front belly and side belly so that the user may sing a song and have conversation.

Further, the first and second acupressure belts 110*b* and 110*c* may be detached from the acupressure pad 110*a* and may be used as a seat belt for an emergency of an accident.

The joystick 120*a* is disposed on an upper side of a grip of the wheelchair 10 and connected to the driving part 130 by a cable. The joystick 120*a* has a stick protruded from the upper side of the grip and the acupressure section 110 may pressure the belly when the user moves the grip forwardly.

Here, acupressure intensities of the acupressure pad 110*a* and the first and second acupressure belts 110*b* and 110*c* are adequately configured for a size of the user's belly, and the maximum pressure to the belly may be uniform even if the user moves the joystick 120*a* forward as much as the user can.

The safe button 120*b* is disposed at the side of the joystick 120*a*. When the joystick 120*a* is not controllable, the user may stop an operation of the driving part 130 connected to the joystick 120*a* by pressing the safe button 120*b* and protect the user.

Referring to FIG. 2, a first end portion of the belt 130*a* is connected to the first acupressure belt 110*b* and a second end portion of the belt 130*a* is connected to the second acupressure belt 110*c* after passing through the retractor 130*c*. The belt 130*a* is wound in the retractor 130*c* and unwound itself round the inside of the retractor 130*c* by the operation of the motor 130*b* connected to an upper side of the retractor 130*c*.

A spring is disposed inside the refractor 130*c* so that the retractor 130*c* unravels the belts 130*a* when the motor 130*b* is not working. The motor 130*b* is connected to the upper side of the retractor 130*c* and is combined with the controlling part 120 by a cable.

Thus, the user may pull the belt 130*a* by controlling the joystick 120*a* and operating the motor 130*b*. When the belt 130*a* is wound inside the retractor 130*c* and pulls the acupressure section 110, the user's belly may be pressured by the acupressure pad 110*a* and the first and the second acupressure belts 110*b* and 110*c*.

However, when the user pulls the joystick 120*a* to a user's body, the motor 130*b* stops operating and the pressure to the belly decreases as the belt 130*a* and the acupressure section 110 are released by unwinding the belt 130*a* from the refractor 130*c*.

In FIG. 2, the motor case 160 is disposed on a rear surface of the back support of the wheelchair 10, and the driving part 130 is disposed at a middlethereof. The battery 130*d* is disposed at a bottom of the motor case 160. The battery 130*d* is connected to the motor 130*b* and supplies an electrical power to the motor 130*b*.

The case door 170 is formed on a middle of the motor case 160 to recharge and exchange the battery 130*d* or to repair and change the driving part 130. The case door 170 is openable and a space inside the case door 170 increases convenience.

Figure 3:
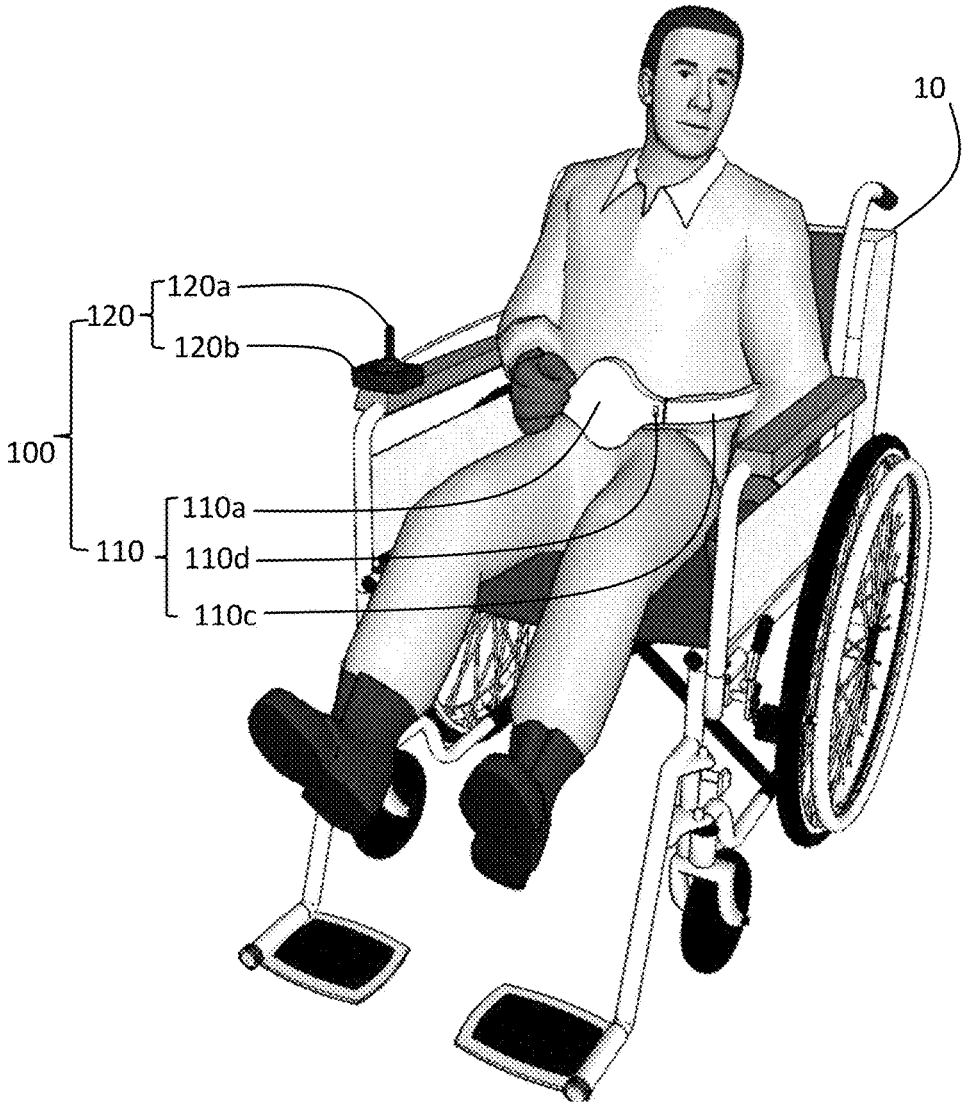
FIG. 3 is an perspective view illustrating an example use of the acupressure device around a belly in FIG. 1.

FIG. 3 is an perspective view illustrating an example use of the acupressure device around a belly in FIG. 1.

Referring to FIG. 3, the first acupressure belt 110*b* or the second acupressure belt 110*c* is connected to the acupressure pad 110*a* so that the acupressure section 110 covers the belly and the acupressure device is finally disposed around the belly. The acupressure pad 110*a* covers up the belly and the first and second acupressure belts 110*b* and 110*c* covers at the right and left sides of the belly.

Thus, when the user has problems in breathing or needs to speak loudly by out-breathing, the user may move the joystick 120*a* forward and pressure the belly. In addition, as described above, the acupressure section 110 may be used for a seat belt and a massage belt by installing a vibration motor inside the acupressure pad 110*a* or exchanging the motor 130*b* for the vibration motor.

Figure 4A:
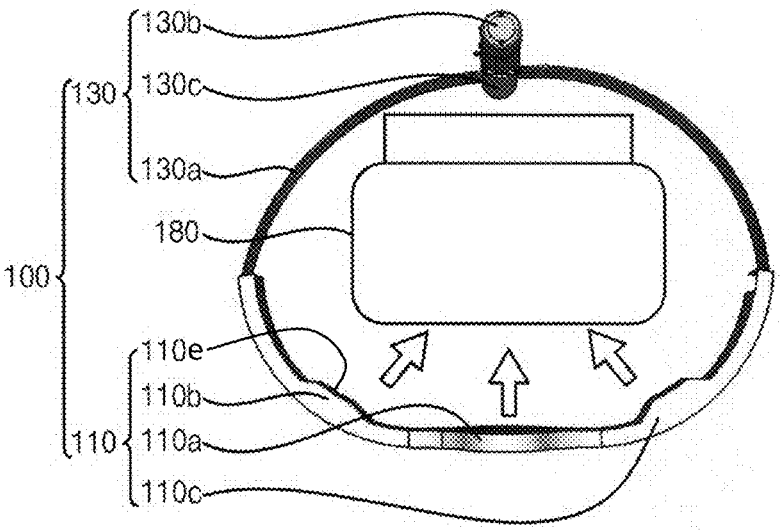
FIGS. 4A and 4B are plan views illustrating an example of pressuring the belly by using the acupressure device.
Figure 4B:
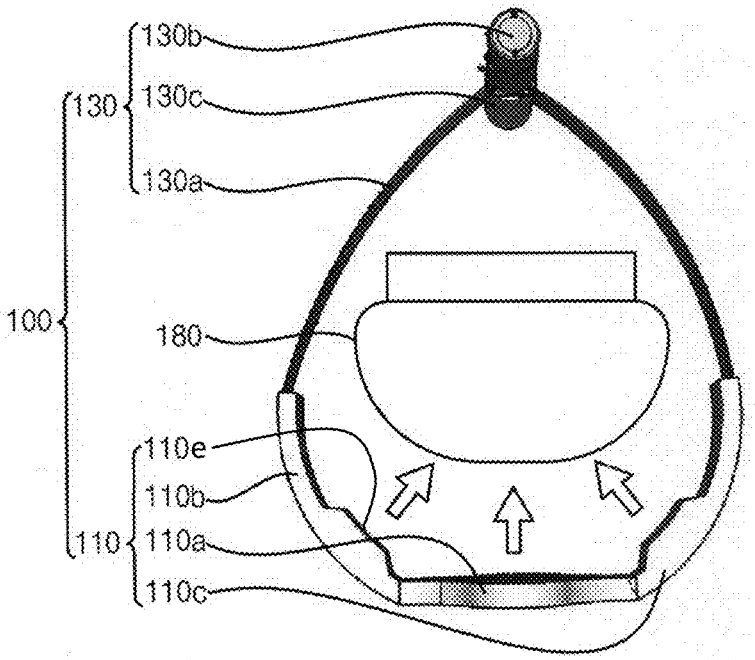

FIGS. 4A and 4B are plan views illustrating an example of pressuring the belly by using the acupressure device.

Referring to FIGS. 4A and 4B, the first and second belts 110*b* and 110*c* are disposed at the right and left sides of the belly 180, and the acupressure pad 110*a* is disposed in front of the belly 180. Here, the joystick 120 moves, and then the motor 130*b* is driven so that the retractor 130*c* pulls the belt 130*a*. In addition, as the belt 130*a* is wound inside the retractor 130*c*, the acupressure pad 110*a* and the first and second acupressure belts 110*b* and 110*c* press the belly 180 so that an intensity of an exhalation increases and helps the vocalization by the pressure of the belly.

Figure 5:
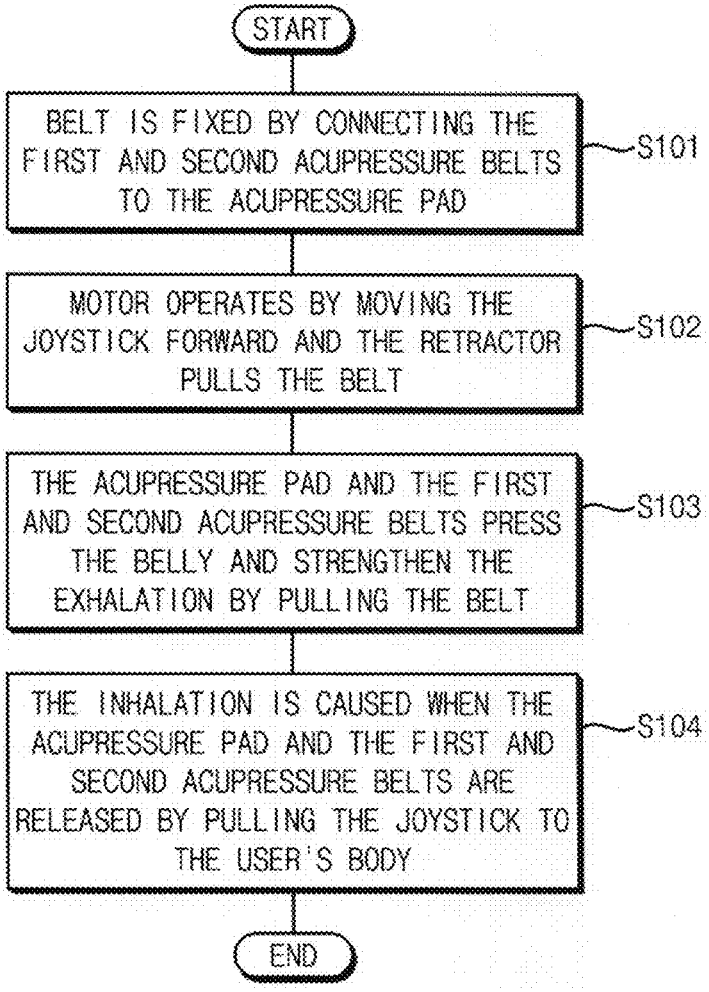
FIG. 5 is a flow chart illustrating an operation of the acupressure device.

FIG. 5 is a flow chart illustrating an operation of the acupressure device.

Referring to FIG. 5, the belt is fixed by connecting the first and second acupressure belts 110*b* and 110*c* to the acupressure pad (step S101).

The motor 130*b* operates by moving the joystick 120 forward and the retractor 130*c* pulls the belt 130*a* (step S102).

When the belt is pulled, the acupressure pad 110*a* and the first and second acupressure belts 110*b* and 110*c* press the belly and strengthen the exhalation (step S103).

The inhalation is caused when the acupressure pad 110*a* and the first and second acupressure belts 110*b* and 110*c* are released by pulling the joystick 120 to the user's body(step S104).

Figure 6:
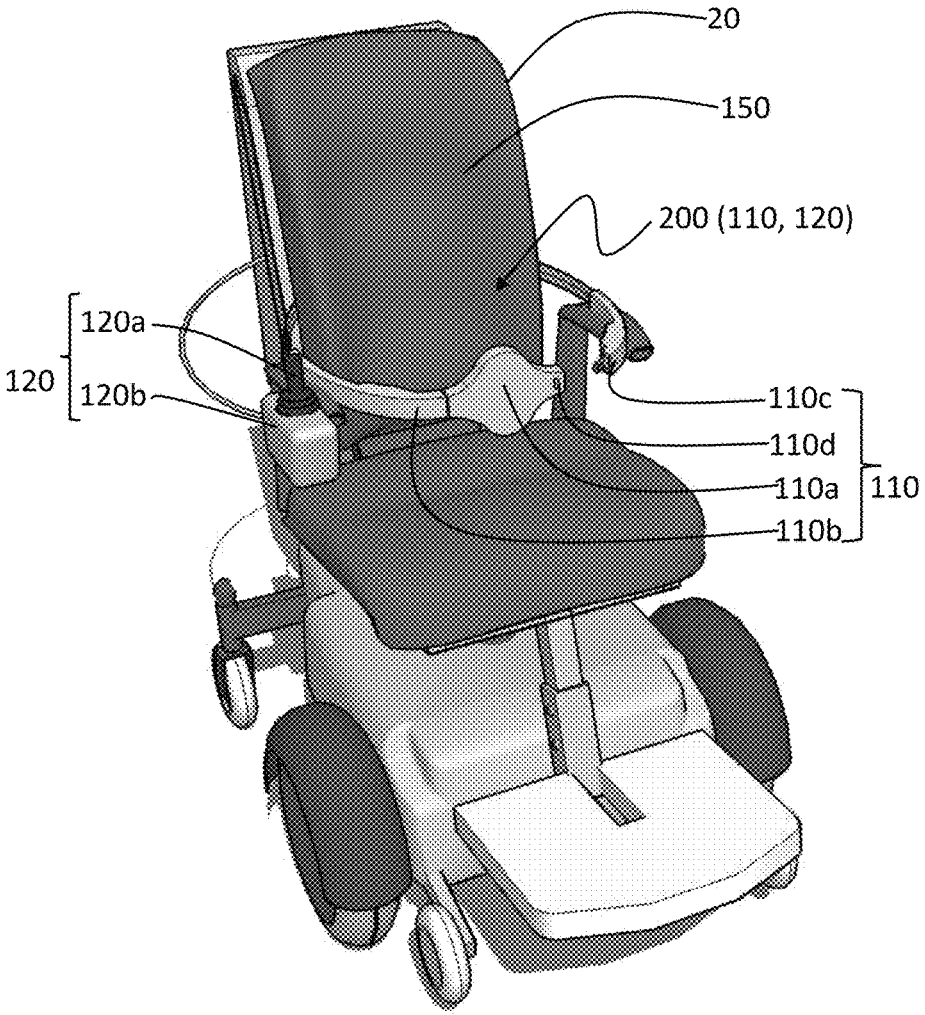
FIG. 6 is a perspective view illustrating an acupressure device combined with an electric wheelchair according to another example embodiment of the present invention.
Figure 7:
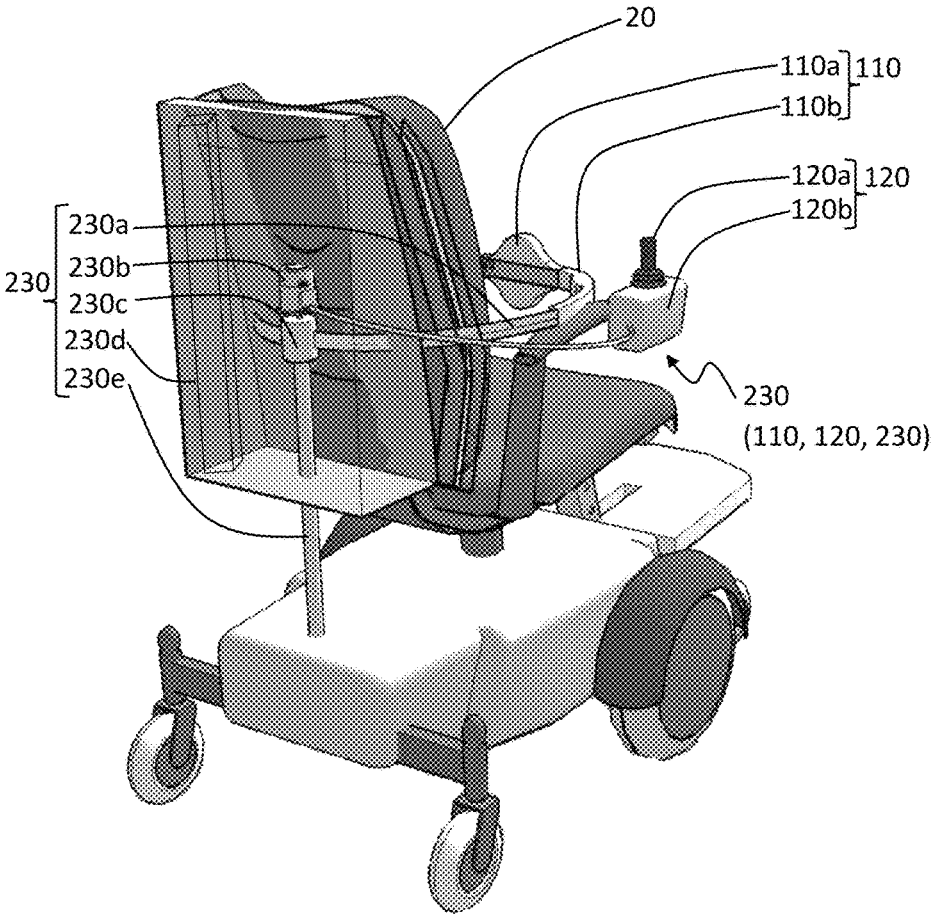
FIG. 7 is a perspective view illustrating the acupressure device combined with the electric wheelchair in FIG. 6.

FIG. 6 is a perspective view illustrating an acupressure device combined with an electric wheelchair according to another example embodiment of the present invention. FIG. 7 is a perspective view illustrating the acupressure device combined with the electric wheelchair in FIG. 6.

The acupressure device 200 according to the present example embodiment is substantially same as the acupressure device 100 in FIGS. 1 and 2 except for a driving part 230 and a wheelchair 20, and thus the same reference numerals are used and repetitive explanation will be omitted.

Referring to FIGS. 6 and 7, the acupressure device 200 includes a driving part 230 and an electric wheelchair 20, and the driving part 230 includes belt 230*a*, motor 230*b*, a retractor 230*c*, a shaft 230*e* and a batter 230*d*.

The electric wheelchair 20 moves by a control of the control part 120 and the joystick 120*a* controls the moving direction of the electric wheelchair 20. However, when the electric wheelchair 20 stops, the controlling mean 120 may automatically control the driving part 230.

In addition, when the users press the safe button 120*b* in controlling the electric wheelchair 20 by using the joystick 120*a*, the electric wheelchair 20 stops and the users may control the driving part 230 and the acupressure section 110 by delivering a driving force of the electric wheelchair motor to the shaft 230*e*. Thus, an additional control device is unnecessary and thus usability is increased.

As the shaft 230*e* is connected to a bottom of the retractor 230*c*, the acupressure device 200 is rotatable by the driving force of the electric wheelchair 20 without an operation of the motor 230*b*, and the retractor 230*c* may pull the belt 230*a* inside.

The belly is pressed by pulling the acupressure pad 110*a* and the first and second acupressure belts 110*b* and 110*c* through the power of the motor inside the electric wheelchair 20. Thus, the acupressure device 200 may be manufactured with a relatively low cost price because the motor 230*b* and the battery 230*d* are optional when the acupressure device 200 is connected to the electric wheelchair 20.

According to those examples of embodiment, the acupressure device is highly portable and helps people using wheelchair breathe by ergonomically pressing the belly with a pad and belt so that the acupressure device decreases the possibility of low blood pressure and shock and increases the convenience for use and stability of the device.

In addition, the acupressure device may press the belly in the moment of singing or practicing the vocalization and be adaptable to music with a fast tempo because the intensity of the pressure of the acupressure device may be controlled minutely and quickly. In addition, the acupressure device may be useful as a seat belt when the acupressure pad is connected to the second acupressure belt. The acupressure device has the safe button 120*b* which stops the wheelchair 10 and allows the joystick 120*a* to control the intensity of the pressure.

In addition, the acupressure device 100 helps old and disabled people significantly to lose their belly's fat when the acupressure pad and the first and second acupressure belts is used as a massage belt by exchanging the motor 230*b* for the vibration motor.

The foregoing is illustrative of the present teachings and is not to be construed as limiting thereof. Although a few exemplary embodiments have been described, those skilled in the art will readily appreciate from the foregoing that many modifications are possible in the exemplary embodiments without materially departing from the novel teachings and advantages of the present disclosure of invention. Accordingly, all such modifications are intended to be included within the scope of the present teachings. In the claims, means-plus-function clauses are intended to cover the structures described herein as performing the recited function and not only structural equivalents but also functionally equivalent structures.

What is claimed is:

1. An acupressure device comprising:
   - an acupressure section configured to be disposed in front of a belly of a user for pressing the belly;
   - a driving part connected to the acupressure section and configured to be fixed at a backside of the user, and for moving the acupressure section toward the belly; and
   - a control part configured to be controlled by the user for changing an intensity of a pressure applied by the acupressure section;
   - wherein the acupressure section comprises:
     - an acupressure pad configured to make contact with a middle of the belly, having spherical protrusion disposed on upper and lower sides of the acupressure pad and configured to pressure a front of the belly, wherein the acupressure pad having a motor inside of the acupressure pad; and
     - first and second acupressure belts detachably connected to both ends of the acupressure pad respectively, and each having protrusions configured to pressure a side of the belly;
   - wherein the driving part comprises a belt connected to the first and second acupressure belts respectively.

2. The acupressure device of claim 1, wherein the driving part further comprises:
   - a retractor wherein the belt is wound or unwound by the retractor; and
   - a motor for driving the retractor.

3. The acupressure device of claim 1 further comprising a wheelchair, wherein the driving part is fixed to the wheelchair on which the user rides, and the acupressure section is fixed to the wheelchair.

4. The acupressure device of claim 3, wherein the acupressure section is disposed at a front portion of the wheelchair and the driving part is disposed at a rear portion of the wheelchair.

5. The acupressure device of claim 4, further comprising a motor case covering the driving part, wherein the motor case comprises:
   - a battery supplying an electric power to the driving part; and
   - a case door opening and closing an inner space.

6. The acupressure device of claim 3, wherein the control part comprises:
   - a joystick for controlling the driving part; and
   - a safe button adjacent to the joystick for stopping an operation of the driving part.

7. The acupressure device of claim 3, wherein the wheelchair is an electric wheelchair.

8. The acupressure device of claim 7, wherein the control part comprises a joystick controlling a movement of the electric wheelchair.

* * * * *